US007411442B2

(12) United States Patent
Yokoo

(10) Patent No.: US 7,411,442 B2
(45) Date of Patent: Aug. 12, 2008

(54) CONSTANT CURRENT CIRCUIT OPERATING INDEPENDENT OF TEMPERATURE

(75) Inventor: Satoshi Yokoo, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 43 days.

(21) Appl. No.: 11/505,921

(22) Filed: Aug. 18, 2006

(65) Prior Publication Data

US 2007/0046364 A1 Mar. 1, 2007

(30) Foreign Application Priority Data

Aug. 30, 2005 (JP) ..... 2005-248880

(51) Int. Cl.
*G05F 1/10* (2006.01)
*G05F 3/02* (2006.01)

(52) U.S. Cl. ..... 327/538; 327/513; 327/543; 323/312; 323/315

(58) Field of Classification Search ..... 327/512, 327/513, 538–543; 323/312, 313, 315
See application file for complete search history.

(56) References Cited

U.S. PATENT DOCUMENTS 5,557,194 A * 9/1996 Kato ..... 323/315
5,910,749 A * 6/1999 Kimura ..... 327/541
6,348,832 B1 * 2/2002 Chih ..... 327/538
6,522,117 B1 * 2/2003 Young et al. ..... 323/315
6,667,653 B2 * 12/2003 Kronmueller et al. ..... 327/538
6,724,244 B2 * 4/2004 Wu ..... 327/543
6,759,893 B2 * 7/2004 Gailhard et al. ..... 327/513
7,071,767 B2 * 7/2006 Ou-yang et al. ..... 327/539

* cited by examiner

*Primary Examiner*—N. Drew Richards
*Assistant Examiner*—Patrick O'Neill
(74) *Attorney, Agent, or Firm*—Oliff & Berridge, PLC

(57) ABSTRACT

In CMOS processing, there may be a case in which a resistance element, such as a poly-silicon resistance, or the like, may be formed which has negative temperature characteristics. In a constant current circuit using this resistance element, a constant current output less affected by the influence of varying temperature is obtained. To a load-side path of a current mirror circuit, a serial connection circuit and a temperature compensation circuit are arranged in parallel each other. The serial connection circuit includes a transistor Q1, a resistance element R1 and a bipolar transistor Q6 and flows a current I1 having positive temperature characteristics. The temperature compensation circuit includes a transistor Q8 and a resistance element R2 and flows a current I2 having negative temperature characteristics. A constant current output based on the sum current I of the currents I1 and I2 is obtained.

4 Claims, 2 Drawing Sheets

(related art)

CONSTANT CURRENT CIRCUIT OPERATING INDEPENDENT OF TEMPERATURE

CROSS-REFERENCE TO RELATED APPLICATIONS

The priority application number JP2005-248880 upon which this patent application is based is hereby incorporated by reference.

BACKGROUND OF THE INVENTION

1. Field of the Invention

The present invention relates to a constant current circuit which is manufactured as a semiconductor integrated circuit, and in particular to achievement of stable characteristics relative to varying temperature.

2. Description of the Related Art

Conventionally, a variety of constant current circuits have been conceived with various ideas applied thereto to obtain a constant current which is less affected by the influence of varying temperature.

FIG. 1 is a diagram showing a structure of a conventional constant current circuit. Specifically, Metal Oxide Semiconductor Field Effect Transistors (MOSFET) Q1 and Q2, and MOSFETs Q3 and Q4, respectively constitute current mirror circuits, and these transistors Q1 through Q4 operate such that equivalent currents I flow through a first path which includes the MOSFETs Q1 and Q4 and a second path which includes the MOSFETs Q2 and Q3. The gate of the MOSFET Q5 is connected to the gate of the MOSFET Q4 which has a gate and a drain being short-circuited. As a result, the pair of the MOSFETs Q4 and Q5 also constitute a current mirror circuit in which a current which is equivalent to the currents I flowing through the first and second paths, respectively, is extracted from the drain of the MOSFET Q5 as an output of the constant current circuit.

Further, in the circuit shown in FIG. 1, as a structure to suppress the influence of varying temperature, a resistance element R1 and a PNP transistor Q6 are serially connected between the source of the MOSFET Q1 and the ground, while a PNP transistor Q7 is serially connected between the source of the MOSFET Q2 and the ground. The MOSFET Q6 is set n time the size of the MOSFET Q7. Each of the MOSFETs Q6 and Q7 is a diode-connected transistor in which the base and collector thereof are short-circuited. Based on the current-voltage characteristics of the respective MOSFETs Q6 and Q7 in the above described condition and with a condition that equivalent voltages are applied to the MOSFET Q7 and the serially connected MOSFET Q6 and resistance R1, respectively, the current I takes the value obtained by the following expression.

$$I=V_T\cdot\ln(n)/R1 \quad (1)$$

wherein $V_T$ represents a heat voltage which is expressed as follows using electron charge q, Boltzmann constant k, and absolute temperature T, $$V_T=kT/q \quad (2)$$

A typical resistance element, such as a discrete resistance element, has positive temperature characteristics, and, as is obvious from Expression (2), a heat voltage $V_T$ also has positive temperature characteristics. Therefore, change of the current I due to varying temperature can be suppressed as the respective positive temperature characteristics of the heat voltage $V_T$ and the resistance R1 are mutually offset in the current I given by Expression (1).

Here, in CMOS (Complementary Metal Oxide Semiconductor) processing, for example, a PNP transistor can be prepared as a parasitic element which has a collector formed utilizing a P-type semiconductor substrate (P-sub). Therefore, it is possible to manufacture a constant current circuit as shown in FIG. 1 in the form of a semiconductor integrated circuit manufactured through CMOS processing.

However, in CMOS processing, a resistance element, such as a poly-silicon resistance or the like, having negative temperature characteristics may be formed. In such a case, a problem is expected in which the circuit shown in FIG. 1 cannot enjoy the effect that the temperature characteristics of the heat voltage $V_T$ and the resistance R1 are offset to each other. On the contrary, the heat voltage $V_T$ and the resistance R1 may synergistically work on such that the temperature characteristics of the current I is enhanced in the position direction.

SUMMARY OF THE INVENTION

The present invention has been conceived in order to solve the above-described problem, and aims to provide a constant current circuit in a semiconductor integrated circuit in which change of an output current thereof due to varying temperature is suppressed.

According to one aspect of the present invention, there is provided a constant current circuit formed as a semiconductor integrated circuit having a resistance element constructed having negative temperature characteristics, comprising a current mirror circuit having a first transistor and a second transistor having gates thereof being connected to each other, for generating a mirror current for a first path including the first transistor and a second path including the second transistor; a serial connection circuit including a first diode structure and a first resistance element and connected between the first transistor and a predetermined reference power supply; and a second diode structure connected between the second transistor and the reference power supply, and generating a constant current according to the mirror current.

The constant current circuit according to the present invention further comprises a temperature compensation circuit provided in parallel to the serial connection circuit, for generating a current having negative temperature characteristics. Through the first path, a current obtained by adding a current flowing through the temperature compensation circuit and a current flowing through the serial connection circuit, flows as the mirror current.

DESCRIPTION OF THE PREFERRED EMBODIMENTS

In the following, a constant current circuit according to an embodiment of the present invention (hereinafter referred to as an embodiment) will be described while referring to the accompanied drawings. This constant current circuit is a semiconductor integrated circuit manufactured through CMOS processing, and formed on a P-type semiconductor substrate (P-sub), for example.

Figure 2:
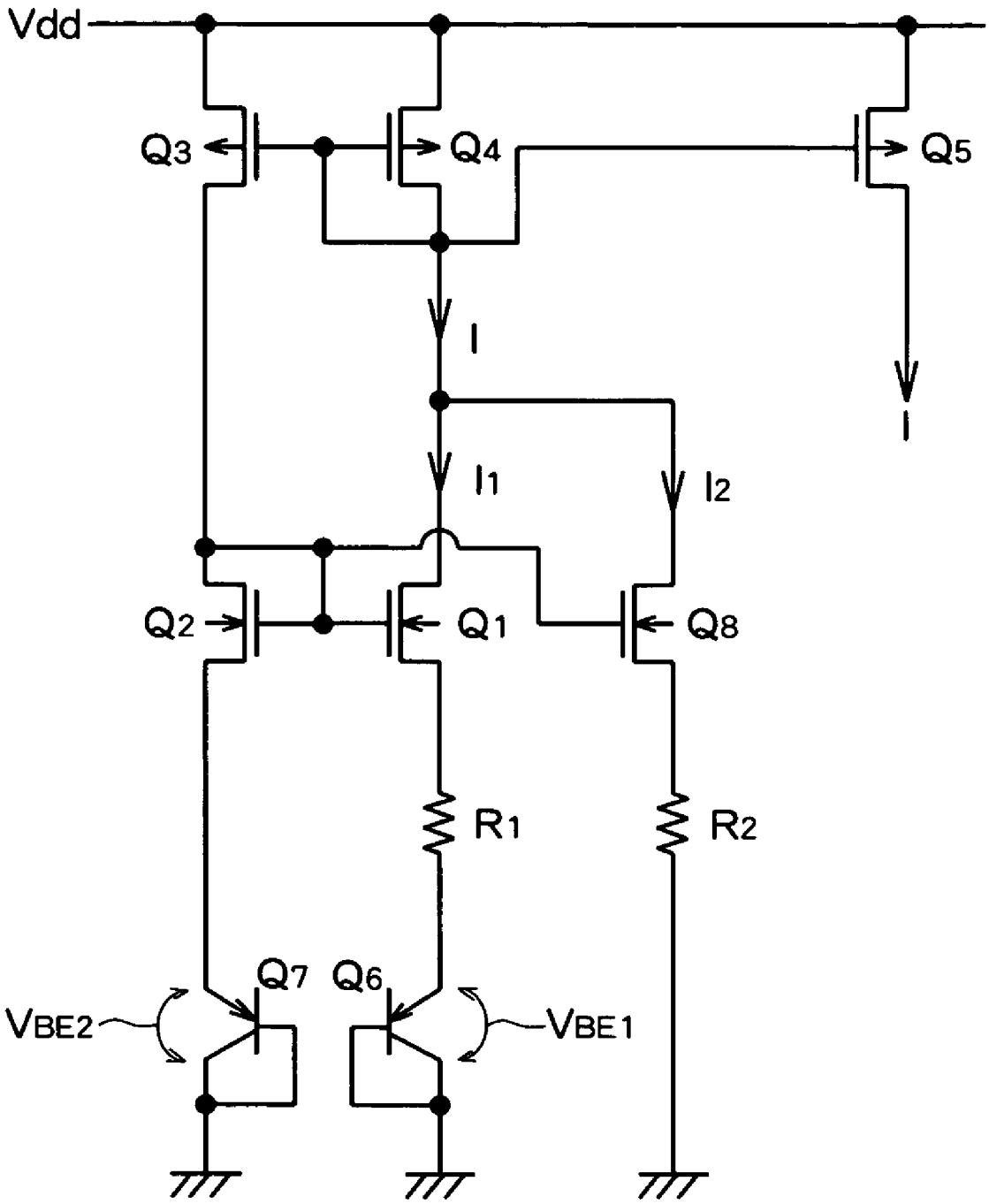
FIG. 2 is a schematic circuit diagram showing a structure of a constant current circuit according to an embodiment of the present invention, in a semiconductor integrated circuit manufactured through CMOS processing.

FIG. 2 is a schematic circuit diagram showing a structure of this constant current circuit. The transistors Q1, Q2, and Q8 are each formed using an n-channel MOSFET, while the transistors Q3 through Q5 are each formed using a p-channel MOSFET. Each of the transistors Q6 and Q7 is a PNP-type bipolar transistor, and formed as a parasitic element having a collector formed utilizing a P-sub. The resistance elements R1 and R2 are poly-silicon resistances, and formed having a resistance value with a negative temperature coefficient (that is, negative temperature characteristics) depending on the condition such as the amount of impurities being diffused or the like.

The sources of the transistors Q3 through Q5 are connected to a predetermined positive voltage source Vdd. The gate and drain of the transistor Q4 are connected to each other. Further, the gate of the transistor Q4 is also connected to the gates of the transistors Q3 and Q5. The transistors Q3 and Q4 and the transistors Q4 and Q5 respectively constitute current mirror circuits.

With the above, a current which is equivalent to the source-drain current I of the transistor Q4 flows through the transistors Q3 and Q5. In particular, the transistor Q5 constitutes an output circuit of the constant current circuit, so that the current flowing through the transistor Q5 is extracted as an output of the constant current circuit.

The drains of the transistors Q1 and Q8 are connected to the drain of the transistor Q4, while the drain of the transistor Q2 is connected to the drain of the transistor Q3. Also, the gate and drain of the transistor Q2 are connected to each other. The gates of the transistors Q1 and Q8 are connected to the gate of the transistor Q2, and receive common gate voltages. Here, as the source-drain current I of the transistor Q4 is divided so as to flow into the transistors Q1 and Q8, respectively, the following Expression is obtained, $$I=1+I2$$

wherein the source-drain currents of the transistors Q1 and Q8 are denoted as I1, I2, respectively.

Between the source of the transistor Q1 and the ground, the resistance R1 and the transistor Q6 are serially connected, while, between the source of the transistor Q2 and the ground, the transistor Q7 is serially connected. The transistor Q6 is set n times the size of the transistor Q7. Each of the transistors Q6 and Q7 is a diode-connected transistor having a base and a collector thereof being short-circuited to each other.

Figure 1:
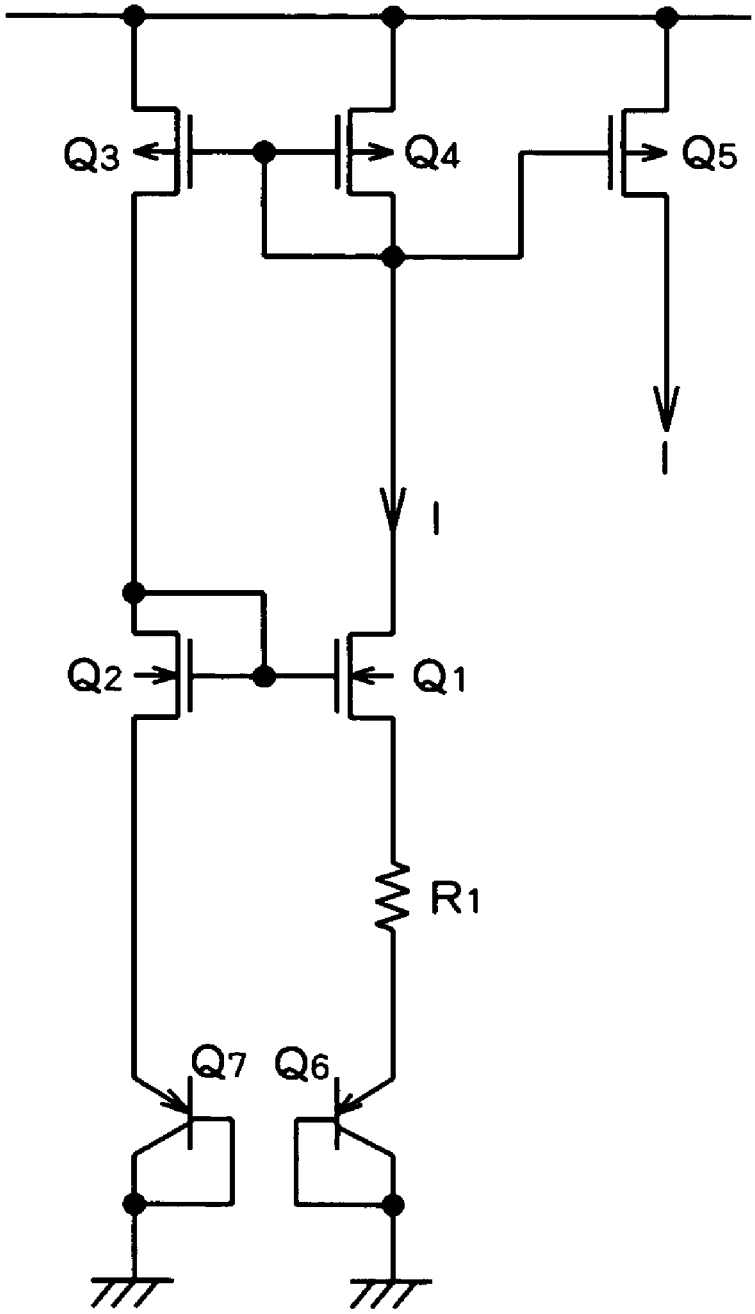
FIG. 1 is a circuit diagram showing a structure of a conventional constant current circuit.

The above-described circuit structure differs from the circuit as shown in FIG. 1 in that a path formed by the transistor Q8 and the resistance R2 to function as a temperature compensation circuit is provided.

In the following, a structure in which no temperature compensation circuit is provided will be described. In this case, in addition to the pair of the transistors Q3 and Q4, the pair of the transistors Q1 and Q2 also constitutes a current mirror circuit in which the source-drain currents of the respective transistors Q1 and Q2 are both denoted as current I.

The relationship equation of the voltage-current concerning the diode-connected transistors Q6 and Q7 are as follows.

$$I=Is\cdot\exp(qV_{BE2}/kT) \tag{3}$$

$$I=nIs\cdot\exp(qV_{BE1}/kT) \tag{4}$$

in which $V_{BE1}$ and $V_{BE2}$ refer to base-emitter voltages of the transistors Q6 and Q7, respectively, and Is refers to a parameter which is determined based on a diffusion coefficient, a diffusion distance, density, and so forth of the holes and electrons in the base and emitter, respectively.

As the source potential of the transistor Q1 and that of the transistor Q2 are equal to each other, the following expression is held.

$$V_{BE2}=V_{BE1}+R1\cdot I \tag{5}$$

From Expressions (3) through (5), the above-described Expression (1), that is, $$I=V_T\cdot\ln(n)/R1 \tag{1}$$

is obtained.

On the other hand, as for the temperature compensation circuit, the following expression is held as the source potential of the transistor Q8 takes a value which is equivalent to the source potential of the transistor Q2.

$$I2=V_{BE2}/R2 \tag{6}$$

In this constant current circuit, as a part of the current I flows into the transistor Q8, the current I1 flowing into the transistor Q1 becomes smaller than the value expressed by Expression (1). Therefore, the following is obtained using a parameter $\xi<1$, $$I1=\xi V_T\cdot\ln(n)/R1 \tag{7}$$

As described above, as the voltage heat $V_T$ has positive temperature characteristics, and, in addition, the resistance element has negative temperature characteristics in this constant current circuit, the current I1 expressed by Expression (7) has positive temperature characteristics.

Meanwhile, where the voltage $V_{BE2}$ which affects the current I2 is basically the forward voltage of the diode, it is known, when silicon is used as the semiconductor, that the value thereof is about 0.7 V at normal temperature, and that the temperature coefficient thereof is −2.0 through −2.5 mV/deg. That is, the voltage $V_{BE2}$ has negative temperature characteristics. Whether the temperature characteristics of the current I2 becomes either positive or negative depends on the relative magnitudes of the negative temperature characteristics of the voltage $V_{BE2}$ and of the resistance R2.

Specifically, the value of about −2.0 mV/deg, described above as the temperature coefficient of the forward voltage of a diode, is a relatively large value, that is, large enough to allow utilization of the temperature characteristics of the diode in, for example, a temperature sensor. Therefore, in general, the magnitude of the negative temperature characteristics of the poly-silicon resistance becomes smaller than the magnitude of the negative temperature characteristics of the forward voltage of the diode. In such a case, the temperature characteristics of the current I2 becomes negative, based on Expression (6).

In this constant current circuit, a part of the current I, namely, a current I2, is led to flow into the temperature compensation circuit which comprises the transistor Q8 and the resistance R2. With the above, the influence of the positive temperature characteristics of the current I1 relative to the temperature characteristics of the current I is offset and modified by the negative temperature characteristics of the current I2. This makes it possible to produce a constant current I in the transistor Q5, which is less affected by varying temperature.

It should be noted that the degree of offset of the temperature characteristics of the currents I1 and I2 can be adjusted by changing the ratio of these currents. In particular, by adjusting such that the absolute values of the amount of change of the current I2 due to the negative temperature characteristics thereof and the amount of change of the current I1 due to the positive temperature characteristics thereof become equal, change of the constant current output due to varying temperature is preferably suppressed.

It should be noted that although the temperature compensation circuit is formed comprising the transistor Q8 and the resistance R2 and that the current I2 is led from the drain side of the transistor Q1 by branching the current flow in the above-described structure, the temperature compensation circuit may be alternatively constructed such that a resistance element is connected to the source of the transistor Q1 in parallel to the serial connection circuit formed comprising the resistance R1 and the transistor Q6.

Also, the circuit structure may be simplified by substituting diodes for the diode-connected bipolar transistors Q6 and Q7, respectively.

As described above, a constant current circuit according to the present invention is formed as a semiconductor integrated circuit having a resistance element constructed having negative temperature characteristics, comprising a current mirror circuit having a first transistor and a second transistor having gates thereof being connected to each other, for generating a mirror current for a first path including the first transistor and a second path including the second transistor, a serial connection circuit including a first diode structure and a first resistance element and connected between the first transistor and a predetermined reference power supply, and a second diode structure connected between the second transistor and the reference power supply, and generating a constant current according to the mirror current.

This constant current circuit further comprises a temperature compensation circuit provided in parallel to the serial connection circuit, for generating a current having negative temperature characteristics. Through the first path, a current obtained by adding a current flowing through the temperature compensation circuit and a current flowing through the serial connection circuit flows as the mirror current.

The temperature compensation circuit may be constructed having a second resistance element serially arranged to the current path thereof, in which the second resistance element receives a voltage according to a voltage applied to the second diode structure.

In the above-described embodiment, the resistance R2 corresponds to the second resistance element.

Also, the temperature compensation circuit may be constructed having a third transistor arranged in parallel to the first transistor and constituting a part of the first path, in which the second resistance element is connected between the third transistor and the reference power supply. In the above-described embodiment, the transistor Q8 corresponds to the third transistor.

The first diode structure and the second diode structure may be constructed each comprising a diode-connected bipolar transistor, similar to the transistors Q6 and Q7 in the circuit in the above-described embodiment.

Also, as described above, it is constructed such that an amount of change of the current flowing through the temperature compensation circuit due to the negative temperature characteristics thereof has a magnitude which is balanced with an amount of change of the current flowing through the serial connection circuit due to the positive temperature characteristics thereof.

As the current flowing through the serial connection circuit which constitutes the first path is determined according to the serial connection circuit including the first diode structure and the first resistance element, and the second diode structure, and the resistance element has negative temperature characteristics, the current resultantly has positive temperature characteristics, as described above.

According to the present invention, a temperature compensation circuit for generating a current having negative temperature characteristics is provided in parallel to the serial connection circuit. With this arrangement, the current flowing through the first path corresponds to the sum of the current flowing through the temperature compensation circuit and the current flowing through the serial connection circuit. That is, as the change of a current component due to varying temperature, which flows through the serial connection circuit is wholly or partially offset by the change of a current component due to varying temperature, which flows through the temperature compensation circuit, the change of the current due to varying temperature, which flows through the first path is resultantly suppressed.

Further, as a current according to the current flowing through the first path, which is suppressed from being changed due to varying temperature as described above is extracted as a constant current output, there can be provided a constant current circuit which is less affected by the influence of varying temperature.

What is claimed is:

1. A constant current circuit formed as a semiconductor integrated circuit having a resistance element with negative temperature characteristics, and having a current mirror circuit including a first transistor in a first path and a second transistor in a second path, gates of the first transistor and the second transistor being connected to each other, and generating a first current for a first path depending on a second current flowing through the second path, the constant current circuit generating a constant current, the constant current circuit, comprising:

a temperature compensation circuit, provided in parallel with the first path, for generating a third current having negative temperature characteristics, wherein the first path comprises a serial connection circuit including a first diode structure and a first resistance element connected between the first transistor and a predetermined reference power supply, the second path comprises a second diode structure connected between the second transistor and the reference power supply, the temperature compensation circuit comprises a third transistor and a second resistance element connected between the third transistor and the reference power supply, the second resistance element receives a voltage according to a voltage applied to the second diode structure, the third transistor configures the current mirror circuit with the first and second transistors and generates the third current depending on the second current, and the output current is formed by adding the first current and the third current.

2. The constant current circuit according to claim 1, wherein the first diode structure and the second diode structure each comprises a diode-connected bipolar transistor.

3. The constant current circuit according claim 1, wherein an amount of change of the current flowing through the temperature compensation circuit due to the negative temperature characteristics of the temperature compensation circuit has a magnitude which is balanced with an amount of change of the current flowing through the serial connection circuit due to positive temperature characteristics of the serial connection circuit.

4. A constant current circuit formed as a semiconductor integrated circuit having a resistance element constructed having negative temperature characteristics, comprising:

a current mirror circuit having a first transistor in a first path, a second transistor in a second path and a third transistor in a third path, gates of the first transistor, the second transistor and the third transistor being connected to each other, the current mirror circuit generating a first current for the first path and a third current for the third path depending on the second current flowing through the second path; and an output circuit for outputting a constant output current, wherein the first path comprises a serial connection circuit including a first diode structure and a first resistance element connected between the first transistor and a predetermined reference power supply, the second path comprises a second diode structure connected between the second transistor and the reference power supply, the third path comprises a temperature compensation circuit, provided in parallel with the first path, for generating the third current having negative temperature characteristics, the temperature compensation circuit comprises a second resistance element connected between the third transistor and the reference power supply, the second resistance element receives a voltage according to a voltage applied to the second diode structure, and the output circuit generates the output current by adding the first current and the third current.

* * * * *